US005640789A

United States Patent [19]

Spurgeon

[11] Patent Number: 5,640,789

[45] Date of Patent: Jun. 24, 1997

[54] SPRINGROD NEEDLEWORK STAND

[76] Inventor: Gregory A. Spurgeon, 8448 Paddock Hills La., Dorsey, Ill. 62021

[21] Appl. No.: 660,077

[22] Filed: Jun. 3, 1996

[51] Int. Cl.[6] ..... D06C 3/08; A47B 97/04

[52] U.S. Cl. ..... 38/102.2; 248/465.1

[58] Field of Search ..... 38/102, 102.1, 38/102.2, 102.4, 102.9, 102.91; 248/581, 592, 599, 441.1–455, 465.1

[56] References Cited

U.S. PATENT DOCUMENTS

| | | | |
|---|---|---|---|
| D. 244,755 | 6/1977 | Bard | 38/102.2 X |
| 406,119 | 7/1889 | White | 38/102.2 |
| 699,263 | 5/1902 | Vosler | 38/102.2 |
| 3,091,886 | 6/1963 | Nutting | 348/445 |
| 3,906,648 | 9/1975 | Bard | 38/102.2 |
| 3,955,722 | 5/1976 | Bard | 38/102.2 X |
| 4,569,498 | 2/1986 | Ermanski | 248/441.1 |
| 4,590,695 | 5/1986 | McGillivray | 38/102.2 |
| 4,596,372 | 6/1986 | Ford | 248/446 X |
| 4,987,690 | 1/1991 | Aaldenberg et al. | 248/447 X |
| 5,027,989 | 7/1991 | Nevius | 38/102.1 X |
| 5,119,572 | 6/1992 | Graham | 38/102.2 |
| 5,357,699 | 10/1994 | Padawer | 38/102 |
| 5,388,352 | 2/1995 | Ralph | 38/102.1 |

*Primary Examiner*—Ismael Izaguirre
*Attorney, Agent, or Firm*—Bruce E. Burdick

[57] ABSTRACT

A simple sturdy needlework stand, preferably metallic. The stand comprises a base, a leg projecting upwardly from the base, a horizontal arm cantilevered from and attached to the leg, a spring connected to the arm and leg for yieldably resisting downward movement of the arm relative to the leg, and a workpiece attachment adapter at an outer end of the arm.

23 Claims, 1 Drawing Sheet

44
36
28

24
44
30
28
32
34
20
26
27
19
16
36
38
22
18
18a
20
16
20a
22

14
42
10
40
12
46
48

SPRINGROD NEEDLEWORK STAND

BACKGROUND OF THE INVENTION

1. Field of the Invention

This invention relates to textile smoothing implements, particularly cloth-stretcher frames such as those classed in US Class 38, Subclass 102+, and still more particularly those with a stand.

2. Related Art

Needlework support stands have been used for about a century or more. Indeed U.S. Class 38, subclass 102.1 and 102.2 contain numerous patents relating to needlecraft stands. Indeed, such devices date back to at least 1899, as evidenced by U.S. Pat. No. 699,263, filed May 10, 1899 and patented May 6, 1902.

For purposes of discussion here, U.S. Pat. No. 5,027,989 issued Jul. 2, 1991 to David L. Nevius appears representative of the state of the art of such stands, although the Nevius stand is too complex for commercial viability. The Nevius stand includes a worktable, light box, fabric holder and pattern holder each mounted by an individually adjustable arm on a single support leg with a large base plate. This gives tremendous adaptability of the unit, but makes the cost and number of parts quite high. Also, the supporting structures are wood, and thus susceptible to breakage under relatively modest stress, such as the unit being knocked over inadvertently or a child climbing on it.

Simpler needlework stands such as in U.S. Pat. No. Des. 244,755 issued Jun. 21, 1977 to Donald Bard, typically have low cost wooden parts but have the drawback of low strength. Even more complex stands such as in U.S. Pat. Nos. 3,906,648; 3,955,722; 4,590,695; and 5,357,699 have low strength wooden construction to reduce cost and enhance portability, and have a large number of parts. This leads to increased breakage and difficulty of repair and largely defeats the objective of low cost.

A sturdier and simpler needlework stand is therefor needed, and is provided by the present invention.

SUMMARY OF THE INVENTION

It is in view of the above problems that the present invention was developed.

It is an object of the invention to provide a less complex needlework stand than stands such as those in U.S. Pat. Nos. 5,027,989 or 5,357,699.

It is an object of the invention to provide a needlework stand that is sturdier and less susceptible to breakage than stands such as those in U.S. Pat. Nos. 5,027,989 or 5,357,699.

It is an additional object of preferred versions of the invention to reduce tipping of the stand.

The invention achieves these objects by providing a simple sturdy needlework stand, preferably metallic.

The needlework stand of the invention comprises a base, a vertical leg, a horizontal arm cantilevered from and attached to the leg, a spring connected to the arm and leg for yieldably resisting downward pressure on the arm, and a frame attachment adapter at an outer end of the arm.

The stand preferably has an easel mounted atop the arm and this easel is preferably mounted reversibly to allow for right or left handed use of the stand.

The leg is preferably braced with a brace extending from the base to a medial portion of the leg so as to help prevent rotation or bending of the leg, thus making the stand very sturdy.

The arm and leg are preferably made of metal rods and are preferably integrally made of a single rod containing also the spring, the spring being a simple loop in the single rod so as to give a stiff and sturdy spring between the arm and leg which is downwardly (and incidentally also upwardly) yieldable.

These objects, advantages and structures will be more easily understood by reference to the enclosed drawing.

Further features and advantages of the present invention, as well as the structure and operation of various embodiments of the present invention, are described below in detail.

The invention will be better understood by reference to the accompanying drawing which consists of three exemplary figures showing the "best mode" (preferred embodiment) currently known to the present inventor or inventors of the invention, and which are not intended to describe all variations which might be within the scope of the invention as claimed below, but rather to illustrate the claimed invention such as to enable one of ordinary skill in the relevant art to make and use the claimed invention. It is noted that since the intention is to have a simple structure, the best stand is not necessarily the most complex and hence the simple stand shown should not be interpreted to mean that more complex stands are outside the scope of the invention since even complex stands may use the inventive features described below to advantage.

DESCRIPTION OF THE PREFERRED EMBODIMENTS

Figures 1, 2, 3:
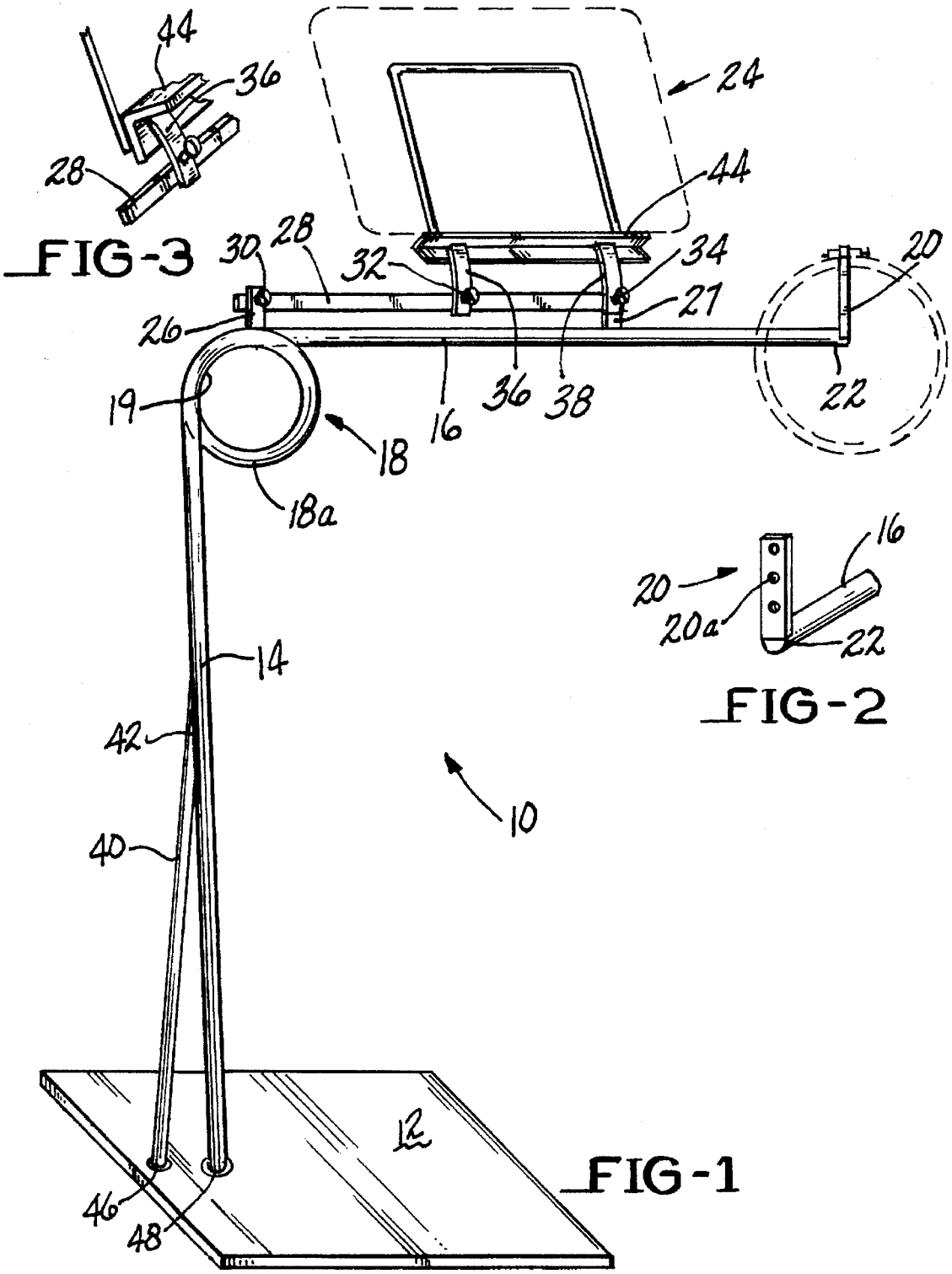
FIG. 1, a perspective view of the preferred simple sturdy springrod needlework stand of the invention, and showing an attached cross-stitch fabric frame in phantom and a supported pattern book in phantom.
FIG. 2, an end perspective view of an apertured flat bar of FIG. 1 to show how the attachment of the cross-stitch holder would be made simple.
FIG. 3, a side perspective view of the attachment of the easel to the arm of the stand of FIG. 1.

The invention will be described by reference to FIGS. 1–3. The embodiment of the invention shown there is a springrod needlework stand 10 which comprises a base 12, a vertical leg 14 projecting upwardly from the base, a horizontal arm 16 cantilevered from and attached to the leg, a spring 18 connected between the arm and leg and adapted to yieldably resist downward movement of the arm relative to the leg, and a frame attachment adapter 20 at an outer end 22 of the arm.

The stand preferably has an easel 24 releasably attached to and supported by the arm by welded arm tabs 26–27, easel support rod 28, thumbscrews 30, 32, 34 and easel tabs 36, 38 atop the arm 16. This easel 24 is mounted reversibly, since screws 30 and 34 or 32 and 34 can be removed and the easel turned around and then the screws reattached to allow for right or left handed use of the stand.

The leg is preferably braced with a brace 40 attached to the leg and base and extending from the base to a medial portion 42 of the leg so as to help prevent rotation and bending of the leg relative to the base, thus making the stand very sturdy.

The arm and leg are preferably made of metal rods and are preferably integrally made of a single rod containing also the spring 18, the spring being a simple loop in the single rod so as to give a stiff and sturdy spring between the arm and leg which is downwardly (and incidentally also upwardly) yieldable. A weld 19 is preferably place at a selected location on the interior side of the spring 18 between the loops of the spring to set the amount of resistance in the spring.

By way of exemplary construction, the stand 10 can be made as follows. Base 12 can be a 12"×12"×¼" (30 cm×30 cm×0.64 cm) metal plate or any other relatively heavy shape and material low enough to fit under the bottom of a typical recliner chair. The leg 14, arm 16 and spring 18 can be made of one integral ⅜" (1 cm) metal rod of a total length of 60" (150 cm), giving a height from plate of 26" (65 cm), a distance of 21" (53 cm) from leg to outer end 22 of the arm. The metal for the various metal parts of the stand could be any suitable metal such as steel, brass, iron or other metal depending on the user's desires.

The spring 18 can simply be a coil in the metal rod of about 1¼ revolutions, or could be ¾, 1¾, 2¼, 2¾, or other desired degree of coil which would be either ¾ or ¼ of a revolution plus any number of full revolutions as found appropriate for achieving the desired amount of resistance to downward movement of the arm. The spring 18 is shown by way of example as being a 3½" (9 cm) coil in the metal rod bent 1.25 revolutions to form a spring action yieldably resisting downward rotation of arm 16 relative to leg 14. The loops of the spring are preferably connected together, such as by welding or a metal band or other connective device in the overlapping portion, which would be the first ¼ and final ¼ of the 1¼ revolutions. The connection is made at a selected location between the first ¼ revolution of a first loop and the first ¼ revolution one or more subsequent loop or loop portion of the rod forming the spring, whereby to render the active portion of the spring less than ¼ of a revolution and making part of the active portion of the spring as being of two or more rod thickesses. The remaining portion of the spring loops 18*a* thus become a handle for moving the stand and a decoration to enhance the appearance.

The adapter 20 can be a ½"×⅛"×4½" (1.27 cm×0.32 cm×11.4 cm) flat metal bar with 3 holes of 3/16" (0.48 cm) spaced ½" (1.27 cm) apart and can be welded to the outer end 22 of the arm 16 in a conventional manner. The welded arm tabs 26–27 can be ½"×⅛"×2" (1.27 cm×0.32 cm ×5 cm) metal bars welded onto a front or rear side of the arm 16 and projecting upwardly therefrom and having a 3/16" (0.48 cm) hole ½" (1.27 cm) from the top of the tab in order to receive a fastening device such as a machine screw. The easel support bar 28 can be a metal bar ½"×⅛"×14" (1.27 cm×0.32 cm×36 cm) metal bar with three 3/16" (0.48 cm) holes and extending between and adapted to be releasably attached to tabs 26 and 27 by two ⅛" (0.32 cm) machine screws each passing through a respective one of the 3/16" (0.48 cm) holes and secured with wing nuts. Easel 24 can be a ¼" (0.64 cm) metal rod bent with 9" (23 cm) verticals and attached to the back of an easel rest 44 with two easel tabs 36, 38 projecting downwardly from and attached to the rest. Tabs 36,38 can be two ½"×⅛"×3" (1.27 cm×0.32 cm×7.62 cm)) metal bars with a 3/16" hole (0.48 cm) ½" (1.27 cm) from the lower end. The easel rest can be a ½"×½"×10" (1.27 cm×1.27 cm×25.4 cm) metal angle bar and the upper ends of the tabs 36,38 can be welded to the front of a downwardly projecting portion of the angle bar. The tabs 36–38 (and thus easel 24) can be releasably secured to the easel support bar 28 by ⅛" (0.32 cm) machine screws with wing nuts 32,34.

The base 12 can be welded to the bottom of leg 14 and a ⅜" (0.95 cm) metal rod 18" long can serve as brace 40 and can be welded at its top to a medial portion 42 of leg 16 and at its bottom to base 12. Base 12 can be provided with two recesses 46, 48 which are 7/16" (1.11 cm) in diameter and 3/16" (0.48 cm) deep to facilitate the placement and welding of the lower end of the leg and brace. The base is preferably rectangular and the leg is attached to the base at an offset location at about half the distance from front to back hue less than about one-third of the distance from a side to the other and the arm extends in the toward that other side so that the lateral center of gravity of the stand is over the base inward of the other side. Preferably the base is a flat metal plate weighing more than the arm. More preferably, the base has a weight at least as great as the total weight of the arm, spring and easel, and may even comprise more than half the total weight of the stand.

While the preferred embodiment specified above is given with precise dimensions, those dimensions are only for purposes of example, it being understood that the dimensions may vary to suit particular customer's desires. For example the leg and arm could be shorter or longer if desired. Additional braces could be added if desired. The arm and leg rod could be thicker or thinner depending on the amount of bending resistance desired in spring 18 and the size and weight of the needlework to be attached to frame adapter 20, and the resistance of spring 18 can be precisely controlled by the placement of weld 19. The easel could be replace by any number off different holders depending on the use desired. In fact the easel could even serve usefully as a painters easel for a painter that wanted to paint while seated, or if the leg was elevated the painter could sit on a high stool or stand. Since the easel is removable, it could be made of other materials, shapes or sizes as desired. Frame adapter 20 could also be shaped and sized differently if a larger or smaller frame was to be supported, and the holes through adapter 20 could be sized appropriately to the standard sizes for such frames.

In all this it is seen that a simple construction is achieved which is sturdy and yet flexible in use. In use the base 12 could be slid under the bottom of a recliner or other seating device until the leg 14 rested against the side of the seating device and then the needlework hoop frame or other workpiece could be attached to frame adapter. In the case of a cross-stitch frame, for example, the frame tightening screw would be passed through the hole 20*a* in the adapter 20 and a nut placed on the screw on the opposite side of the adapter from the frame and tightened to hold the frame thereon.

In view of the foregoing, it will be seen that the stated objects of the invention are achieved. The above description explains the principles of the invention and its practical application to thereby enable others skilled in the art to best utilize the invention in various embodiments and with various modifications as are suited to the particular use contemplated. As various modifications could be made in the constructions and methods herein described and illustrated without departing from the scope of the invention, it is intended that all matter contained in the foregoing description shall be interpreted as illustrative rather than limiting. Thus, the breadth and scope of the present invention should not be limited by any of the above-described exemplary embodiments, but should be defined only in accordance with the following claims appended hereto and their equivalents.

The patents referenced herein are incorporated in their entirety for purposes of background information and additional enablement.

What is claimed is:

1. A workpiece support stand which comprises:

a base;

a leg projecting upwardly from the base;

an arm attached to and projecting horizontally from the leg;

a spring between the arm and leg and adapted to yieldably and resiliently resist downward movement of the arm relative to the leg; and an easel attached to and supported by the arm, the base having a weight at least as great as the total weight of the arm, spring and easel.

2. A workpiece support stand which comprises:

a base;

a leg projecting upwardly from the base;

an arm attached to and projecting horizontally from the leg;

a spring between the arm and leg and adapted to yieldably and resiliently resist downward movement of the arm relative to the leg; and an easel attached to and supported by the arm, the base having a weight at least as great as the total weight of the arm, spring and easel, and the leg, arm and spring are one integral metallic rod.

3. The stand of claim 2 wherein the spring is a coil in the rod at the junction of the leg and arm.

4. The stand of claim 3 wherein the coil is of a desired degree of coil which would be about either ¾ or ¼ of a revolution plus any number of full revolutions.

5. The stand of claim 4 wherein a weld is placed between loops of the spring at a selected location so as to precisely adjust the amount of resistance of the spring.

6. The stand of claim 5 wherein the number of revolutions in the spring is ¼ of a revolution plus any number of full revolutions and the selected weld location is between the first ¼ revolution of a first loop and the first ¼ revolution each subsequent loop or loop portion of the rod forming the spring.

7. The stand of claim 6 further comprising a workpiece adapter attached to an outer end of the arm for facilitating attachment of a workpiece frame to the arm.

8. The stand of claim 7 wherein the means of attachment of the easel to the arm includes a pair of tabs downwardly projecting from the easel and releasably attachable to at least one of the upwardly projecting tabs from the arm.

9. The stand of claim 5 wherein the number of revolutions in the spring is 1¼ revolutions and the selected weld location is between the first ¼ revolution and the fifth ¼ revolution of the rod forming the spring.

10. The stand of claim 9 wherein the adapter is a flat bar projecting upwardly from the arm with portion defining at least one passageway therethrough for receiving a fastening device from a needlework frame.

11. The stand of claim 9 wherein the means of attachment of the easel to the arm includes a pair of tabs upwardly projecting from the arm and releasably attached to the easel.

12. The stand of claim 4 wherein the coil is of about 1¼ revolutions.

13. The stand of claim 1 further comprising at least two tabs projecting upwardly from the arm and an easel having downwardly projecting tabs removably attached to the upwardly projecting tabs.

14. The stand of claim 1 further comprising a brace attached to the base and leg for preventing rotation and bending of the leg relative to the base.

15. The stand of claim 14 wherein the base is substantially rectangular and the leg is attached to the base at an offset location at about ½ the distance from front to back but less than ⅓ the distance from a side to the other and the arm extends in a direction from the leg toward that other side so that the lateral center of gravity of the stand is over the base inward of the other side.

16. The stand of claim 1 wherein the arm has an outer end and the base is a flat metal plate weighing more than the arm and substantially more than half the weight of the base is disposed toward the outer end of the arm from the leg, whereby to move the center of gravity of the stand toward the outer end of the arm from the leg and thereby make the stand harder to tip.

17. A workpiece support stand which comprises:

a base;

a leg projecting upwardly from the base;

an arm attached to and projecting horizontally from the leg;

a spring between the arm and leg and adapted to yieldably and resiliently resist downward movement of the arm relative to the leg; and an workpiece holder attached to and supported by the arm, the base having a weight at least as great as the total weight of the arm, spring and workpiece holder.

18. The stand of claim 17 wherein the leg, arm and spring are one integral metallic rod.

19. The stand of claim 18 wherein the spring is a coil in the rod at the junction of the leg and arm.

20. The stand of claim 19 wherein the coil is of a desired degree of coil which would be about either ¾ or ¼ of a revolution plus any number of full revolutions.

21. The stand of claim 20 wherein the number of revolutions in the spring is ¼ of a revolution plus any number of full revolutions and, a connection is made at a selected location between the first ¼ revolution of a first loop and the first ¼ revolution one or more subsequent loop or loop portion of the rod forming the spring, whereby to render the active portion of the spring less than ¼ of a revolution and making part of the active portion of the spring as being of two or more rod thickesses.

22. A workpiece support stand which comprises:

a base;

a leg projecting upwardly from the base;

an arm attached to and projecting horizontally from the leg;

a spring between the arm and leg and adapted to yieldably and resiliently resist downward movement of the arm relative to the leg;

a first workpiece holder attached to and supported by the arm, the base having a weight at least as great as the total weight of the arm, spring and workpiece holder; and a second workpiece holder attached to the arm.

23. The stand of claim 2 wherein the first workpiece holder is a pattern holder and the second workpiece holder is an adapter for securing a needlework frame to the arm.

* * * * *